US007454345B2

(12) United States Patent
Sasaki et al.

(10) Patent No.: US 7,454,345 B2
(45) Date of Patent: Nov. 18, 2008

(54) WORD OR COLLOCATION EMPHASIZING VOICE SYNTHESIZER

(75) Inventors: Hitoshi Sasaki, Kawasaki (JP); Yasushi Yamazaki, Kawasaki (JP); Yasuji Ota, Kawasaki (JP); Kaori Endo, Kawasaki (JP); Nobuyuki Katae, Kawasaki (JP); Kazuhiro Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 660 days.

(21) Appl. No.: 11/063,758

(22) Filed: Feb. 23, 2005

(65) Prior Publication Data

US 2005/0171778 A1 Aug. 4, 2005

Related U.S. Application Data

(63) Continuation of application No. PCT/JP03/00402, filed on Jan. 20, 2003.

(51) Int. Cl.
*G10L 13/00* (2006.01)

(52) U.S. Cl. ..... 704/258; 704/260; 704/266

(58) Field of Classification Search ..... 704/258, 704/260, 266

See application file for complete search history.

(56) References Cited

U.S. PATENT DOCUMENTS

| | | | | |
|---|---|---|---|---|
| 4,868,750 | A * | 9/1989 | Kucera et al. | 704/8 |
| 5,529,953 | A | 6/1996 | Shoda | |
| 5,640,490 | A * | 6/1997 | Hansen et al. | 704/254 |
| 6,182,028 | B1 * | 1/2001 | Karaali et al. | 704/9 |
| 6,275,789 | B1 * | 8/2001 | Moser et al. | 704/7 |
| 6,684,201 | B1 * | 1/2004 | Brill | 706/45 |
| 6,751,592 | B1 | 6/2004 | Shiga | |
| 6,947,918 | B2 * | 9/2005 | Brill | 706/45 |
| 7,072,826 | B1 * | 7/2006 | Wakita | 704/2 |

FOREIGN PATENT DOCUMENTS

| | | |
|---|---|---|
| JP | 3-196199 | 8/1991 |
| JP | 5-27792 | 2/1993 |
| JP | 5-80791 | 4/1993 |
| JP | 5-224689 | 9/1993 |
| JP | 9-44191 | 2/1997 |
| JP | 11-249678 | 9/1999 |
| JP | 2000-99072 | 4/2000 |
| JP | 2000-206982 | 7/2000 |
| JP | 10-207491 | 8/2001 |
| JP | 3319555 | 6/2002 |

OTHER PUBLICATIONS

International Search Report dated Feb. 25, 2003; pp. 1-2.

* cited by examiner

*Primary Examiner*—Michael N Opsasnick
(74) *Attorney, Agent, or Firm*—Katten Muchin Rosenman LLP

(57) ABSTRACT

A voice synthesizer, which obtains a voice by emphasizing a specific part of a sentence, includes an emphasis degree deciding unit that extracts a word or a collocation to be emphasized from among respective words or respective collocations on the basis of an extracting reference with respect to the each word or the each collocation included in a sentence and deciding an emphasis degree of the extracted word or the extracted collocation, an acoustic processing unit that synthesizes a voice having an emphasis degree which is decided by the emphasis degree deciding unit applied to the word to be emphasized or the collocation to be emphasized, whereby the emphasized part of the word or the collocation can be obtained automatically on the basis of the extracting reference, such as a frequency of appearance and a level of importance of the word or the collocation.

13 Claims, 15 Drawing Sheets

FIG. 2

39

| WORD | FREQUENCY OF APPEARANCE (NUMBER OF TIMES) | WITH OR WITHOUT EMPHASIS |
|---|---|---|
| 「TEMPORARY」 | 2 | ABSENCE |
| 「ACCENT」 | 4 | PRESENCE |
| ⋮ | ⋮ | ⋮ |
| | | |

FIG. 4

39a

| WORD | FREQUENCY OF APPEARANCE (NUMBER OF TIMES) | FREQUENCY OF APPEARANCE (RANKING) | WITH OR WITHOUT EMPHASIS |
|---|---|---|---|
| 「TEMPORARY」 | 2 | FIFTH | ABSENCE |
| 「ACCENT」 | 4 | FIRST | PRESENCE |
| ⋮ | ⋮ | ⋮ | ⋮ |
| | | | |

FIG. 7

55

| WORD | NUMBER OF TIMES OF APPEARANCE | APPEARED POSITION (NUMBER OF TIMES OF WORDS) | WITH OR WITHOUT OF EMPHASIS | STRONGLY EMPHASIZED POSITION (NUMBER OF TIMES OF WORDS) | WEAKLY EMPHASIZED POSITION (NUMBER OF TIMES OF WORDS) |
|---|---|---|---|---|---|
| 「TEMPORARY」 | 2 | 21,42 | ABSENCE | … | … |
| 「ACCENT」 | 4 | 15,55,83,99 | PRESENCE | 15 | 55,83,99 |
| ⋮ | ⋮ | ⋮ | ⋮ | ⋮ | ⋮ |
| | | | | | |

FIG. 9

64

| WORD | LEVEL OF EMPHASIS |
|---|---|
| 「TEMPORARY」 | ABSENCE |
| 「ACCENT」 | STRONG |
| ⋮ | ⋮ |
| | |

FIG. 11

74

| WORD | WITH OR WITHOUT EMPHASIS |
|---|---|
| 「TEMPORARY」 | ABSENCE |
| 「ACCENT」 | ABSENCE |
| ⋮ | ⋮ |
| 「ALPS」 | PRESENCE |

N−1
N
N+1

CURRENT SECTION

ORIGIN
SYNTHESIZED PART
SYNTHESIZED PART
ORIGIN

WORD OR COLLOCATION EMPHASIZING VOICE SYNTHESIZER

CROSS-REFERENCE TO RELATED APPLICATION

This application is a continuation of International Application PCT/JP2003/000402 was filed on Jan. 20, 2003, the contents of which are herein wholly incorporated by reference.

TECHNICAL FIELD

The present invention relates to a voice synthesizing technology for reading, for example, the inputted sentence and outputting the voice; and particularly, the present invention relates to a voice synthesizer, a voice synthesizing method, and a voice synthesizing system preferable to be used for the voice synthesizing technology to synthesize a voice that can be easily caught by a user by emphasizing a specific part of the sentence.

BACKGROUND ART

Generally, a voice synthesizer reads out a file in a text format composed of a character row including inputted characters, sentences, marks and figures or the like, refers to a dictionary making a plurality of voice waveform data into a library so as to convert the read character row into a voice, and for example, the voice synthesizer is used for a software application of a personal computer. In addition, in order to obtain a natural voice aurally, a voice emphasizing method for emphasizing a specific word in a sentence has been known.

FIG. 13 is a block diagram of a voice synthesizer without using a prominence (to emphasize a specific part). A voice synthesizer 100 shown in this FIG. 13 is configured by a pattern element analyzing unit 11, a word dictionary 12, a parameter generating unit 13, a waveform dictionary 14, and a pitch clipping and superimposing unit 15.

The pattern element analyzing unit 11 analyzes a pattern element (the minimum language unit composing a sentence or the minimum unit having a meaning in the sentence) with respect to the inputted kana-kanji mixed sentence (type-of-character mixed sentence) with reference to the word dictionary 12; decides types of a word (a division of parts of speech), reading of a word, accent or intonation, respectively; and outputs a phonetic symbol with a rhythm mark (an intermediate language). The file in the text format to be inputted in this pattern element analyzing unit 11 is a kana-kanji mixed character row in Japanese, and an alphabet string in English.

As well known, a generation model of a voiced sound (particularly, a vowel) is composed of a voice source (a voice cord), an articulation system (a vocal tract) and a radial opening (a lip); and a voice source signal is generated when the voice cord is oscillated by air from lungs. In addition, the vocal tract is composed of a part from the voice cord to a throat. A shape of the vocal tract is changed by making a diameter of the throat large or small, and when the vocal source signal is resonant with a specific shape of the vocal tract, a plurality of vowels is generated. Then, on the basis of this generation model, a property of a pitch period or the like to be described below is defined.

In this case, the pitch period represents an oscillation period of the voice cord, and a pitch frequency (also referred to as a basic frequency or merely referred to as a pitch) represents an oscillation frequency of the voice cord and a property with respect to a tone of a voice. In addition, the accent represents a temporal change of the pitch frequency of a word and the intonation represents a time dependency of the pitch frequency of the entire sentence. Then, these accent and intonation are physically and closely related to a pattern of time dependency of the pitch frequency. Specifically, the pitch frequency becomes higher at an accent position, and if the intonation is heightened, the pitch frequency becomes higher.

In many case, the voice that is synthesized, for example, a predetermined pitch frequency without using these information such as the accent or the like is read in a monotone, in other words, this voice becomes unnatural aurally like being read by a robot. Therefore, the voice synthesizer 100 outputs the phonetic symbol with a rhythm mark so that a natural pitch change can be generated at a succeeding stage of the processing. An example of the original character row and the intermediate language (the phonetic symbol with the rhythm mark) is described as follows.

A character row:

"akusentowapicchinojikantekihenkatokanrengaaru".

An intermediate language:

"a'ku%sentowa pi'cchio jikanteki he'nkato kanrenga&a'ru."

In this case, "'" represents an accent position, "%" represents an unvoiced consonant, "&" represents a nasal sonant, "." represents a sentence boundary of an assertive sentence, respectively.

Further, "(full size space)" represents a division of a clause.

In other words, the intermediate language is outputted as a character row that is provided with the accent, the intonation, a phoneme duration or a pose duration or the like.

The word dictionary 12 stores (holds, accumulates or memorizes) the types of the word, the reading of the word, and a position of the accent or the like with related to each other.

The waveform dictionary 14 stores the voice waveform data of the voice itself (the phoneme waveform or the phoneme piece), a phoneme label showing which phoneme a specific part of the voice indicates, and a pitch mark indicating the pitch period with respect to the voiced sound.

The parameter generating unit 13 generates, provides or sets a parameter such as a pattern of the pitch frequency, the position of the phoneme, the phoneme duration, the pose duration and a intensity the voice (a voice pressure) or the like with respect to the character row. In addition, the parameter generating unit 13 decides which part of the voice waveform data in the voice waveform data stored in the waveform dictionary 14 is used. By this parameter, the pitch period and the position of the phoneme or the like are decided, and such the natural voice as a person is reading the sentence can be obtained.

The pitch clipping and superimposing unit 15 clips the voice waveform data stored in the waveform dictionary 14, and superimposes (overlaps) and adds the processed voice waveform data having the clipped voice waveform data multiplied by a window function or the like and a part of second voice waveform data belonging to a waveform section at the preceding and succeeding sides of the section (the waveform section) to which this processed voice waveform data belongs to synthesize the voice. As this processing method of the pitch clipping and superimposing unit 15, for example, a PSOLA (Pitch-Synchronous Overlap-add: a pitch conversion method due to addition and superimposing of the waveform) method is used (refer to "Diphone Synthesis Using and Overlap-add Technique for Speech Waveforms Concatenation", ICASSP '86, pp. 2015-2018, 1986).

FIG. 15A to FIG. 15D illustrate an addition and superimposing method of a waveform, respectively. As shown in FIG. 15A, the PSOLA method clips the voice waveform data of two periods from the waveform dictionary 14 on the basis of the generated parameter, and then, as shown in FIG. 15B, the clipped voice waveform data is multiplied by the window function (for example, a Hanning window) to generate processed voice waveform data. Then, as shown in FIG. 15C, the pitch clipping and superimposing unit 15 superimposes and adds a last half of the preceding section of the present section and a first half of the succeeding section of the present section, and by superimposing and adding the last half of the present section and the first half of the succeeding section, a waveform of one period is synthesized (refer to FIG. 15D).

The above description is related to a synthesis when the prominence is not used.

In the next place, with reference to FIG. 14, the synthesis when the prominence is used will be described below.

Various voice synthesizers, which emphasize a specific part of the word or the like designated by a user by means of the prominence, are suggested (for example, Japanese Patent laid-Open HEI5-224689, hereinafter, referred to as a publicly known document 1).

FIG. 14 is a block diagram of a voice synthesizer using a prominence, and here, the prominence is manually inputted. A voice synthesizer 101 shown in this FIG. 14 is different from the voice synthesizer 100 shown in FIG. 13 in that an emphasized word manual inputting unit 26 to designate the setting data showing a part in the inputted sentence and a degree of emphasis by manual input is provided at the input and output side of the pattern element analyzing unit 11. In the meantime, except for the emphasized word manual inputting unit 26, the parts having the same reference numerals as the above-described parts have the same functions.

Then, a parameter generating unit 23 shown in FIG. 14 sets a higher pitch and a longer phoneme length than the voice part that is not emphasized with respect to the part designated by the emphasized word manual inputting unit 26 and generates a parameter to emphasize a specific word. In addition, the parameter generating unit 23 makes amplitude larger at the voice part to be emphasized or generates a parameter such as locating a pose before or after the voice part.

Further, conventionally, many voice emphasizing methods have been suggested.

For example, another voice synthesizing method using the prominence is disclosed in JP-A-5-80791 or the like.

Further, in Japanese Patent Laid-Open HEI5-27792 (hereinafter, referred to as a publicly known document 2), a voice emphasizing apparatus to emphasize a specific key word by providing a key word dictionary (a level of importance dictionary) that is different from reading of the text sentence. This voice emphasizing apparatus disclosed in the publicly known document 2 inputs the voice therein and uses key word detection extracting a characteristic amount of the voice such as a spectrum or the like on the basis of the digital voice waveform data.

However, when using the voice emphasizing method disclosed in a publicly known document 1, the user has to input the prominence manually each time the part to be emphasized appears, so that this involves a problem that the operation becomes complex.

Further, the voice emphasizing apparatus disclosed in the publicly known document 2 does not change an emphasizing level in multi-stages but extracts the key word on the basis of the voice waveform data. Accordingly, there is also a possibility that the operationality is not enough.

DISCLOSURE OF THE INVENTION

The present invention has been made taking the foregoing problems into consideration and an object of which is to provide a voice synthesizer, whereby the emphasized part of a word or a collocation can be automatically obtained on the basis of an extracting reference such as a frequency of appearance and a level of importance or the like of the emphasized part of the word or the collocation and the operationality can be improved by omitting a labor work needed by the manual input of the prominence by the user to synthesize a voice that can be easily caught by the user.

Therefore, the voice synthesizer according to the present invention may comprise an emphasis degree deciding unit for extracting a word or a collocation to be emphasized from among respective words or respective collocations on the basis of an extracting reference with respect to the each word or the each collocation included in a sentence and deciding an emphasis degree of the extracted word or the extracted collocation; and an acoustic processing unit for synthesizing a voice having an emphasis degree that is decided by the emphasis degree deciding unit provided to the word to be emphasized or the collocation to be emphasized.

Accordingly, according to this structure, a complication of the manual inputting of the setting with respect to the part emphasized by the user is solved, and the synthesized voice that can be easily caught by the user can be automatically obtained.

In addition, the emphasis degree deciding unit may comprise a counting unit for counting a reference value with respect to an extraction of each word or each collocation included in the sentence; a holding unit for holding the reference values counted by the counting unit and the each word or the each collocation with related each other; and a word deciding unit for extracting a word or a collocation with a high reference value among the reference values that is held in the holding unit and deciding the emphasis degree with respect to the extracted word or the extracted collocation. Thus, by a relatively simple structure, the prominence is automatically decided and it is possible to omit a lot of troubles imposed on the user.

This emphasis degree deciding unit can decide the emphasis degree as an extracting reference on the basis of the following (Q1) to (Q5).

(Q1) The emphasis degree deciding unit decides the emphasis degree as the extracting reference on the basis of a frequency of appearance of the respective words or the respective collocations. Thus, it is also possible to automatically decide the emphasis degree.

(Q2) The emphasis degree deciding unit decides the emphasis degree as the extracting reference on the basis of a specific proper noun included in the sentence. Thus, it is possible to expect generation of the synthetic voice that can be easily caught by the user in totality by emphasizing the proper noun.

(Q3) The emphasis degree deciding unit decides the emphasis degree as the extracting reference on the basis of a type of a character included in the sentence. Thus, for example, by emphasizing a katakana character, it is possible to generate the synthetic voice that can be easily caught as an entire sentence.

(Q4) The emphasis degree deciding unit decides the emphasis degree as the extracting reference on the basis of an appearance place of the respective words or the respective collocations and a number of times of the appearance place. Specifically, the emphasis degree deciding unit can decide the emphasis degree with respect to the each word or the each collocation at a first appearance place of the each word or the each collocation, and the emphasis degree deciding unit can decide a weak emphasis or no-emphasis at the appearance place where the each word or the each collocation appears on and after a second time. Accordingly, according to this structure, each word is strongly emphasized at the first appearance position and it is weakly emphasized at the second appearance position or thereafter, so that the reading is not redundant and the high quality voice can be obtained.

(Q5) The emphasis degree deciding unit decides the emphasis degree in multi-stages as the extracting reference on the basis of a level of importance that is provided to a specific word or a specific collocation among the respective words or the respective collocations. Accordingly, according to this structure, it is possible to reliably emphasize the word to be emphasized in accordance with the level to be emphasized. Further, the present invention is different from the voice emphasizing apparatus disclosed in the publicly known document 2 using neither key word extraction nor multistage emphasis in that the present invention serves to read the text sentence and does not extract the key word from the voice waveform data.

In addition, the acoustic processing unit may comprise a pattern element analyzing unit for analyzing a pattern element of the sentence and outputting an intermediate language with a rhythm mark to a character row of the sentence; a parameter generating unit for generating a voice synthetic parameter with respect to each word or each collocation that is decided by the emphasis degree deciding unit in the intermediate language with the rhythm mark that is outputted by the pattern element analyzing unit; and a pitch clipping and superimposing unit for superimposing and adding processed voice waveform data obtained by processing first voice waveform data at intervals indicated by the voice synthetic parameter generated by the parameter generating unit and apart of second voice waveform data belonging to a waveform section at the preceding and succeeding sides of this processed voice waveform data to synthesize the voice having the emphasis degree provided to the word or the collocation to be emphasized. In this way, the existing technology can be used without changing a design and a quality of the synthesized voice is more improved.

Then, the voice synthesizer according to the present invention may comprise a pattern element analyzing unit for analyzing a pattern element of a sentence and outputting an intermediate language with a rhythm mark to a character row of the sentence; an emphasis degree deciding unit for extracting a word or a collocation to be emphasized from among respective words or respective collocations on the basis of an extracting reference with respect to the each word or the each collocation included in a sentence and deciding an emphasis degree of the extracted word or the extracted collocation; a waveform dictionary for storing second voice waveform data, the phoneme position data indicating what phoneme a part of the voice belongs, and the pitch period data indicating a period of oscillation of a voice cord; a parameter generating unit for generating a voice synthetic parameter including at least the phoneme position data and the pitch period data with respect to each word or each collocation that is decided by the emphasis degree deciding unit in the intermediate language that is outputted by the pattern element analyzing unit; and a pitch clipping and superimposing unit for superimposing and adding processed voice waveform data obtained by processing first voice waveform data at intervals indicated by the voice synthetic parameter generated by the parameter generating unit and a part of second voice waveform data belonging to a waveform section at the preceding and succeeding sides of this processed voice waveform data to synthesize the voice having the emphasis degree provided to the word or the collocation to be emphasized. Accordingly, according to this structure, it is also possible to decide the emphasis degree automatically.

The pitch clipping and superimposing unit may clip the voice waveform data stored in the waveform dictionary on the basis of the pitch period data generated by the parameter generating unit, and may superimpose and add the processed voice waveform data having the clipped voice waveform data multiplied by a window function and a part of second voice waveform data belonging to a waveform section at the preceding and succeeding sides of the waveform section to which this processed voice waveform data belongs to synthesize the voice. In this way, an auditory sensation is corrected and a natural synthesized voice can be obtained.

The voice synthesizing method according to the present invention may comprise the steps of counting a reference value with respect to extraction of the each word or the each collocation by an emphasis degree deciding unit for extracting a word or a collocation to be emphasized from among respective words or respective collocations on the basis of an extracting reference with respect to the each word or the each collocation included in a sentence and deciding an emphasis degree of the extracted word or the extracted collocation; holding the reference values counted by the counting unit and the each word or the each collocation with related each other; extracting a word or a collocation with a high reference value that is held in the holding step; deciding the emphasis degree with respect to the extracted word or the extracted collocation by the extracting step; and synthesizing the voice having the emphasis degree that is decided by the word deciding step provided to the word or the collocation to be emphasized.

Accordingly, according to this structure, the complication of the manual inputting of the setting with respect to the part emphasized by the user is also solved, and the synthesized voice that can be easily caught by the user also can be automatically obtained.

The voice synthesizing system according to the present invention for synthesizing a voice with respect to an inputted sentence and outputting the voice may comprise a pattern element analyzing unit for analyzing a pattern element of the sentence and outputting an intermediate language with a rhythm mark to a character row of the sentence; an emphasis degree deciding unit for extracting a word or a collocation to be emphasized from among respective words or respective collocations on the basis of an extracting reference with respect to the each word or the each collocation included in a sentence and deciding an emphasis degree of the extracted word or the extracted collocation; a waveform dictionary for storing second voice waveform data, the phoneme position data indicating what phoneme a part of the voice belongs, and the pitch period data indicating a period of oscillation of a voice cord; a parameter generating unit for generating a voice synthetic parameter including at least the phoneme position data and the pitch period data with respect to each word or each collocation that is decided by the emphasis degree deciding unit in the intermediate language that is outputted by the pattern element analyzing unit; and a pitch clipping and superimposing unit for superimposing and adding processed voice waveform data obtained by processing first voice waveform data at intervals indicated by the voice synthetic parameter generated by the parameter generating unit and a part of second voice waveform data belonging to a waveform section at the preceding and succeeding sides of this processed voice waveform data to synthesize the voice having the emphasis degree provided to the word or the collocation to be emphasized.

Accordingly, according to this structure, the voice synthesizing system can transmit and receive the data or a signal via a communication circuit by locating respective functions at remote positions and providing a data transmission and reception circuit to respective functions, and thereby, respective functions can be effected.

BRIEF DESCRIPTION OF THE DRAWINGS

FIG. 2 shows a data example of a first common memory according to the embodiment of the present invention.

FIG. 4 shows a data example of a second common memory according to the embodiment of the present invention.

FIG. 7 shows a data example of a third common memory according to the embodiment of the present invention.

FIG. 9 shows a data example of a fourth common memory according to the embodiment of the present invention.

FIG. 11 shows a data example of a fifth common memory according to the embodiment of the present invention.

BEST MODE FOR CARRYING OUT THE INVENTION

(A) Explanation of an Embodiment According to the Present Invention

Figure 1:
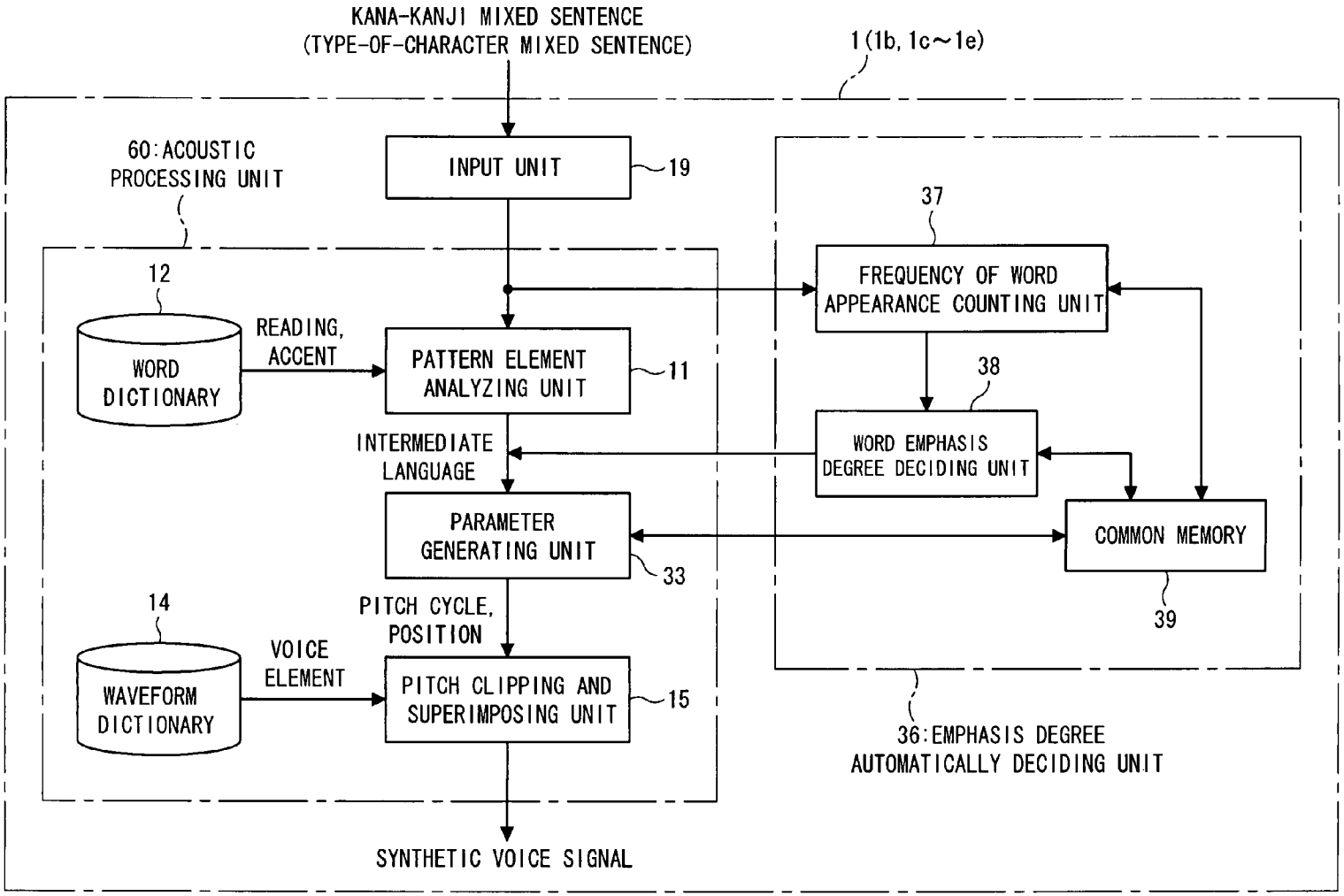
FIG. 1 is a block diagram of a voice synthesizer according to an embodiment of the present invention.

FIG. 1 is a block diagram of a voice synthesizer of an embodiment of the present invention. A voice synthesizer 1 shown in FIG. 1 may synthesize a voice while reading the inputted sentence, and the voice synthesizer 1 is provided with an input unit 19, an emphasis degree automatically deciding unit (emphasis deciding unit) 36, and an acoustic processing unit 60. In this case, the input unit 19 may input a kana-kanji mixed sentence in the acoustic processing unit 60.

In addition, the emphasis degree automatically deciding unit 36 may extract a word or a collocation to be emphasized from among respective words or respective collocations on the basis of an extracting reference with respect to the each word or the each collocation included in a sentence and decide an emphasis degree of the extracted word or the extracted collocation.

In this case, the extracting reference with respect to the each word or the each collocation is a reference for deciding which word or collocation is extracted to be emphasized from among many character rows that are inputted. The emphasis degree automatically deciding unit 36 of the voice synthesizer 1 according to a first embodiment to be described below may decide an emphasis degree on the basis of the frequency of appearance of the above-described respective words or respective collocations. In addition, as this extracting reference, a level of importance of the word, a specific proper noun, and a specific character type or the like such as katakana or the like can be used, and alternatively, various extracting references such as a reference on the basis of the appearance place and the number of times of the frequency of appearance of the respective words or the respective collocations can be used. The voice synthesizing method using respective extracting references will be described later.

In the meantime, voice synthesizers 1*a*, 1*c* to 1*e* shown in FIG. 1 will be described respectively in other embodiments to be described later.

(1) A Structure of the Acoustic Processing Unit 60

The acoustic processing unit 60 may synthesize a voice having the emphasis degree that is decided by the emphasis degree automatically deciding unit 36 provided to the above-described respective words or respective collocations to be emphasized, and the acoustic processing unit 60 is configured by the pattern element analyzing unit 11, the word dictionary 12, a parameter generating unit 33, the waveform dictionary 14, and the pitch clipping and superimposing unit 15.

The pattern element analyzing unit 11 may analyze a pattern element of the inputted kana-kanji mixed; may output the intermediate language with the rhythm mark to the character row of the sentence; may decide types of a word, reading of a word, accent or intonation, respectively; and may output the intermediate language.

For example, a character row of "akusentowapicchinojikantekihenkatokanrengaaru" is inputted in the pattern element analyzing unit 11, a voice parameter such as the accent, the intonation, the phoneme duration or the pose duration or the like is given, and for example, the intermediate language of "a'ku%sentowa pi'cchio jikanteki he'nkato kanrenga&a'ru." is generated.

In addition, the word dictionary 12 may store the types of the word, the reading of the word, and a position of the accent or the like with related to each other. Then, the pattern element analyzing unit 11 may retrieve the word dictionary 12 with respect to the pattern element that is analyzed and obtained by the pattern element analyzing unit 11 itself to obtain the types of the word, the reading or the accent of the word. In addition, the data to be stored in this word dictionary 12 can be updated sequentially, and thus, it is possible to synthesize a voice with respect to a broad range of a language.

Thereby, the character row of the kana-kanji mixed sentence is divided into a word (or a collocation) by analyzing the pattern element analyzing unit 11, and the divided word is provided with the reading and accent or the like respectively to be converted into a reading kana string with the accent.

The parameter generating unit 33 may generate the voice synthetic parameter with respect to respective words and collocations that are decided by the emphasis degree automatically deciding unit 36 in the intermediate language with the rhythm mark outputted from the pattern element analyzing unit 11. In addition, upon generating the voice synthetic parameter in the intermediate language outputted from the pattern element analyzing unit 11, the parameter generating unit 33 may generate the emphasized voice synthetic parameter with respect to respective words and collocations that are decided by the emphasis degree automatically deciding unit 36.

This voice synthetic parameter includes the pattern of the pitch frequency, the position of the phoneme, the phoneme duration, the pose duration added before or after the emphasized part, and the tension of the voice or the like. Due to this voice synthetic parameter, the tension, the tone, and the intonation of the voice, or the insertion time and the insertion place of the pose or the like are decided, and the natural voice is obtained. For example, when reading a paragraph of the sentence, a reader leaves a pose before starting the reading and may read the sentence while emphasizing the starting part or may read the sentence slowly. Thereby, a bunch included in one sentence is identified and emphasized, so that a division of the sentence is made clear.

The waveform dictionary 14 stores the voice waveform data of the voice itself (the phoneme waveform or the phoneme piece), a phoneme label showing which phoneme a specific part of the voice indicates, and a pitch mark indicating the pitch period with respect to the voiced sound. This waveform dictionary 14 selects the waveform data of the appropriate part of the voice waveform data in response to the access from the pitch clipping and superimposing unit 15 to be described below and outputs the phoneme. Thereby, it is decided which part of the voice waveform data in the waveform dictionary 14 is used. In the meantime, the waveform dictionary 14 often holds the voice waveform data in a format of a PCM (Pulse Coded Modulation) data.

The phoneme waveform stored by this waveform dictionary 14 is different depending on a phoneme (a phoneme context) located at the both sides of its phoneme, so that the same phoneme connected to a different phoneme context is treated as a different phoneme waveform. Accordingly, the waveform dictionary 14 holds many phoneme contexts that have been subdivided in advance and improves listenability and smoothness of the synthetic voice. In the meantime, according to the following description, unless particularly stated, the listenability means a level of clarity, and specifically, it means a level of recognition of a sound by a person.

The pitch clipping and superimposing unit 15 uses, for example, the PSOLA method. In accordance with the voice synthetic parameter from the parameter generating unit 33, the pitch clipping and superimposing unit 15 clips the voice waveform data stored in the waveform dictionary 14, and superimposes and adds the processed voice waveform data having the clipped voice waveform data multiplied by a window function and a part of the second voice waveform data in a preceding and succeeding frequency of this processed voice waveform data to output the synthetic voice.

Further, this pitch clipping and superimposing unit 15 will be described in detail below.

The pitch clipping and superimposing unit 15 may synthesize a voice having the emphasis degree provided to the above-described respective words or the collocations to be emphasized by superimposing and adding processed voice waveform data obtained by processing the first voice waveform data at intervals indicated by the voice synthetic parameter generated by the parameter generating unit 33 and a part of the second voice waveform data belonging to a waveform section at the preceding and succeeding sides of this processed voice waveform data.

In addition, the pitch clipping and superimposing unit 15 clips the voice waveform data stored in the waveform dictionary 14, and superimposes and adds the processed voice waveform data having the clipped voice waveform data multiplied by a window function and a part of the second voice waveform data belonging to a preceding frequency and a succeeding frequency of the current frequency to which this processed voice waveform data belongs to output a synthetic voice.

Accordingly, according to this processing, the auditory sensation is corrected and a natural synthesized voice can be obtained.

Specifically, the pitch clipping and superimposing unit 15 clips two frequencies of the voice waveform data from the waveform dictionary 14 on the basis of the generated parameter, and as shown in FIGS. 15A to 15D, respectively, the clipped voice waveform data is multiplied by the window function (for example, a Hanning window) to generate the processed voice waveform data. Then, the pitch clipping and superimposing unit 15 may generate one frequency of the synthetic waveform by adding a last half of the preceding frequency of the present frequency and a first half of the current frequency, and in the same way, the pitch clipping and superimposing unit 15 may generate a synthetic waveform by adding the last half of the current frequency and the first half of the succeeding frequency.

Then, the PCM data stored in the waveform dictionary is converted into analog data by a digital/analog converting unit (its illustration is herein omitted) to be outputted from the pitch clipping and superimposing unit 15 as the synthetic voice signal.

In the meantime, the processed voice waveform data multiplied by the window function is further multiplied by a gain for adjustment of the amplitude according to need. In addition, as the pattern of the pitch frequency in the PSOLA method, a pitch mark indicating the clipping position of the voice waveform is used, and thereby, the pitch frequency is indicated by the intervals of the pitch mark. Further, when the pitch frequency in the waveform dictionary 14 is different from a desired pitch frequency, the pitch clipping and superimposing unit 15 may convert the pitch.

In the next place, the emphasis degree automatically deciding unit will be described in detail below.

(2) A Structure of the Emphasis Degree Automatically Deciding Unit (the Emphasis Degree Deciding Unit) 36

(A1) A First Aspect

The emphasis degree automatically deciding unit 36 shown in FIG. 1 is configured by a frequency of word appearance counting unit 37, a common memory (holding unit) 39, and a word emphasis degree deciding unit 38.

The common memory 39 holds the frequency of appearance counted by the frequency of word appearance counting unit 37 and respective words or respective collocations with related to each other, and the function of the common memory 39 is effected by a memory that can be referred or can be written by the frequency of word appearance counting unit 37, the word emphasis degree deciding unit 38, and the parameter generating unit 33 or the like.

FIG. 2 shows a data example of the first common memory 39 according to the embodiment of the present invention. The first common memory 39 shown in this FIG. 2 stores the word, the frequency of appearance (the number of times) of this word, and absence and presence of the emphasis with related to each other, and a recordable area (for example, the number of lines or the like) can be increased or decreased. For example, the frequency of appearance of a word, "jikanteki" is twice, and a statement that the emphasis of the word, "jikanteki" is not necessary when this word, "jikanteki"

appears in the inputted sentence is written in the first common memory 39. On the other hand, with respect to the word, "akusento", the frequency of appearance is fourth, and this word is emphasized when it appears in the sentence.

Then, the word emphasis degree deciding unit 38 shown in FIG. 1 may extract the words and collocations with high frequency of appearance that are held in the common memory 39 and may decide the emphasis degree with respect to the extracted words or collocations. The emphasis degree automatically deciding unit 36 will be described more detail below.

Figure 3:
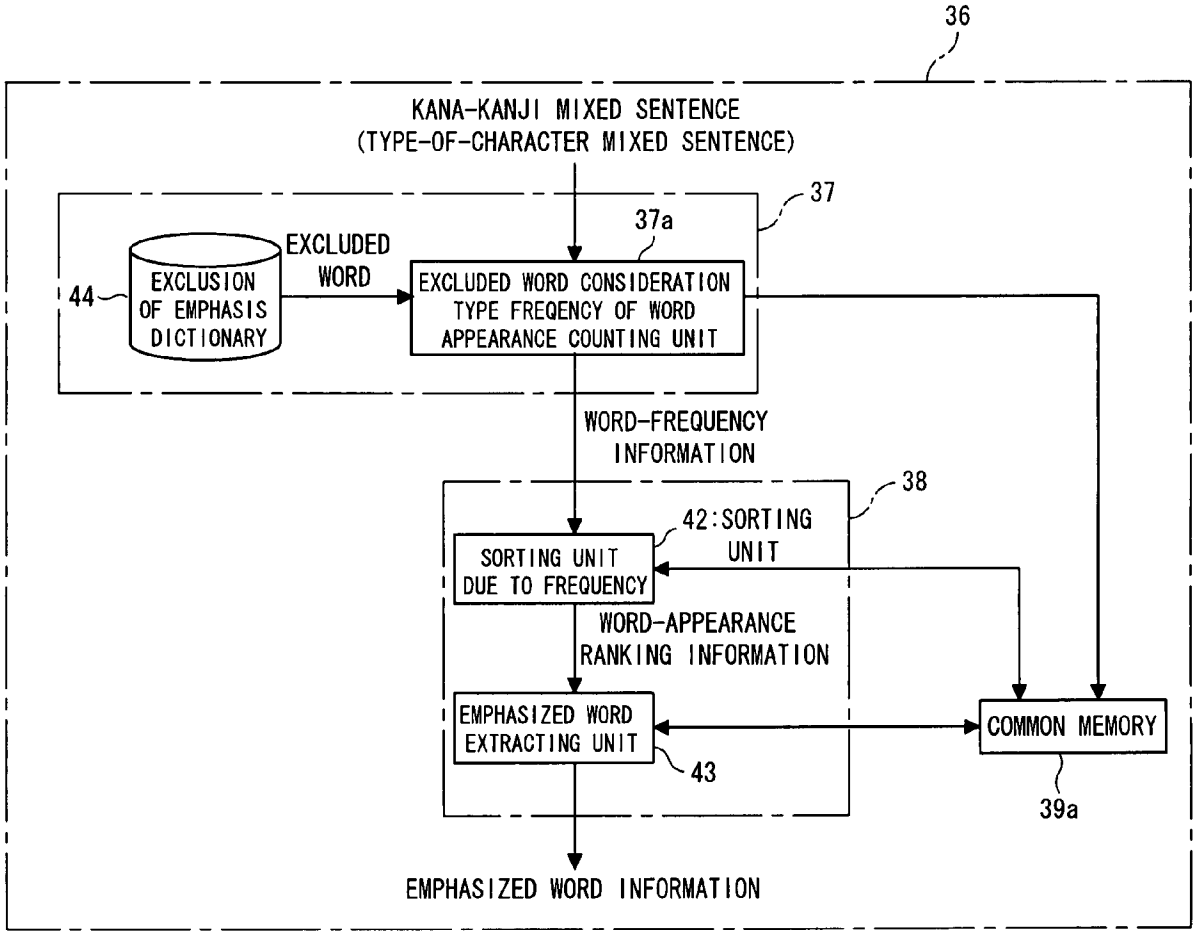
FIG. 3 is a block diagram of a first word emphasis degree deciding unit according to the embodiment of the present invention.

FIG. 3 is a block diagram of the first emphasis degree automatically deciding unit 36 according to the embodiment of the present invention. The frequency of word appearance counting unit 37 of the emphasis degree automatically deciding unit 36 shown in this FIG. 3 is configured by an exclusion of emphasis dictionary 44 and an excluded word consideration type frequency of word appearance counting unit (hereinafter, referred to as a second word appearance counting unit) 37*a*.

In this case, the exclusion of emphasis dictionary 44 may exclude the emphasis with respect to the word or the collocation, of which voice is not necessarily emphasized, in the inputted sentence, and may hold the dictionary data having the information with respect to the character row of a target of exclusion recorded therein. In addition, the dictionary data stored by the exclusion of emphasis dictionary 44 may be appropriately updated, so that the processing which meets sufficiently a customer's needs becomes possible.

Inputting the character row from the input unit 19 (see FIG. 1), the second word appearance counting unit 37*a* may exclude a specific word included in the inputted character row from the word to be emphasized despite its frequency of appearance, may normally count the words that are not excluded, and may record these words and the frequency information with related to each other in the common memory 39*a*. This second word appearance counting unit 37*a* is configured by a sorting (rearrangement processing) unit 42 and an emphasized word extracting unit 43.

Then, the second word appearance counting unit 37*a* retrieves the data of an exclusion of emphasis dictionary 44 in advance in order to determine if the word obtained by processing a language of the inputted character row is a target for exclusion of emphasis or not. Then, depending on the retrieving, obtaining the information with respect to the word to be excluded in advance, the second word appearance counting unit 37*a* may exclude a specific word among the words or the collocations included in the inputted character row, and with respect to the word and the frequency of appearance except for the excluded words or the excluded collocations, the second word appearance counting unit 37*a* may output the word-frequency of pair data information paring the word and the frequency of appearance.

Thereby, the frequency of appearance of the word or the collocation included in the sentence is used as the extraction reference, and the frequency of word appearance counting unit 37 counts this frequencies of appearance.

In the next place, the word emphasis degree deciding unit 38 may output the information with respect to the word to be emphasized in the character row included in the inputted sentence and the word emphasis degree deciding unit 38 is configured by the sorting unit 42 and the emphasized word extracting unit 43. In the meantime, the parts shown in this FIG. 3 having the same reference numerals as the above-described parts are the same parts or have the same functions, so that further explanation thereof is herein omitted.

In this case, the sorting unit 42 may sort (rearrange) the data of the common memory 39*a* on the basis of the frequency of appearance, and may output the word-frequency information paring the word and the order of appearance with respect to the sorted data. This sorting unit 42 may obtain a plurality of data elements from the common memory 39*a* and may rearrange the data elements in accordance with the order from the high-ordered word by using the order of appearance as an axis of rearrangement. In this case, most of the word with the higher order are included in the sentence, and they are often the important words or the key words.

Further, when the word-appearance order information is inputted from the sorting unit 42, the emphasized word extracting unit 43 can extract the emphasized word more accurately by using the appearance order information in this pair data as the axis of the rearrangement. Further, this emphasized word extracting unit 43 may extract the important word or collocation in the character row included in the inputted sentence on the basis of the pair data extracted by the emphasized word extracting unit 43 itself and may output the extracted word or collocation as the word information as with respect to the word to be emphasized.

In the next place, the common memory 39*a* shown in FIG. 3 may hold the frequency of appearance counted by the second word appearance counting unit 37*a* and respective words or respective collocations with related to each other.

FIG. 4 shows a data example of the second common memory 39*a* according to the embodiment of the present invention. The common memory 39*a* shown in this FIG. 4 stores the word, the frequency of appearance (the number of times) of this word, the frequency of appearance (the order) of this word, and absence and presence of the emphasis with related to each other, and the data row of the frequency of appearance (the order) is added to the common memory 39 shown in FIG. 2. In the meantime, the number of lines of the table data shown in this FIG. 4 can be increased or decreased.

For example, assuming that the frequency of appearance of the word, "akusento" included in the inputted sentence is fourth and the frequency of appearance of the word, "jikanteki" included in the inputted sentence is twice, if the frequency of appearance of "akusento" is the most, "rank 1" is written in the data row of the frequency of appearance in the common memory 39*a*, and also with respect to the word, "jikanteki", rank 5 is written in the data row of the frequency of appearance. Then, the sorting unit 42 (see FIG. 3) may sort the data of the common memory 39*a* on the basis of this frequency of appearance.

Thereby, in the excluded word consideration type frequency of word appearance counting unit 37*a*, the frequencies of appearance (the number of times) of respective words in the inputted sentence are counted and the data is stored in the first row and the second row of the common memory 39*a*. In this case, the words described in the exclusion of emphasis dictionary 44 are excluded, and the sorting unit 42 stores the words in a third row of the common memory 39*a* while ranking them in order of the number of times of appearance. In addition, the emphasized word extracting unit 43 decides presence and absence of emphasis with respect to the words, for example, top three of the number of times of appearance and stores these words in a forth row of the common memory 39*a*.

Thereby, the frequencies of appearance of the words or the collocations of the inputted sentence are counted by the frequency of word appearance counting unit 37, and the counting result is written in the common memory 39. The word emphasis degree deciding unit 38 may decide the emphasis degree of the word or the collocation on the basis of the counting result, and may write the decided emphasis degree in the common memory 39. In addition, the parameter generating unit 33 may set a parameter to emphasize the word to be emphasized with reference to the common memory 39. Therefore, without change of the design, the existing technology can be used and a quality of the synthetic voice is more improved.

Accordingly, the present voice synthesizer 1 can obtain the emphasized part (the word, the collocation) automatically on the basis of the frequency of appearance of the emphasized part (the word, the collocation), so that the labor work needed by the manual input of the emphasized part by the user can be solved and the user can automatically obtain the synthetic voice that can be easily caught.

Thus, the word or the collocation with a high frequency of appearance is emphasized. Accordingly, with a relatively simple structure, the prominence is automatically decided, and many labor works of the user can be omitted.

In the above-described voice synthesizer 1, the word or the collocation to be emphasized is extracted on the basis of the frequency of appearance of the word or the collocation included in the sentence to decide the emphasis degree of the word or the collocation. In addition, in the acoustic processing unit 60, the emphasis degree decided by the emphasis degree automatically deciding unit 36 is provided to the word or the collocation to be emphasized to synthesize a voice. In this case, the function of the emphasis degree automatically deciding unit 36 is separated from the function of the acoustic processing unit 60, however, the present invention can be effected even if the functions are not separated.

In other words, the voice synthesizer 1 according to the present invention is configured by the pattern element analyzing unit 11 for analyzing a pattern element of a sentence and outputting an intermediate language with a rhythm mark to a character row of the sentence; the emphasis degree automatically deciding unit 36 for extracting a word or a collocation to be emphasized from among respective words or respective collocations on the basis of the frequency of appearance with respect to the each word or the each collocation included in a sentence and deciding an emphasis degree of the extracted word or the extracted collocation; the waveform dictionary 14 for storing the second voice waveform data, the phoneme position data indicating what phoneme a part of the voice belongs, and the pitch period data indicating a period of oscillation of a voice cord; the parameter generating unit 33 for generating a voice synthetic parameter including the phoneme position data and the pitch period data with respect to each word or each collocation that is decided by the emphasis degree automatically deciding unit 36 in the intermediate language that is outputted by the pattern element analyzing unit 11; and the pitch clipping and superimposing unit 15 for superimposing and adding processed voice waveform data obtained by processing the first voice waveform data at intervals indicated by the voice synthetic parameter generated by the parameter generating unit 33 and a part of the second voice waveform data belonging to a waveform section at the preceding and succeeding sides of this processed voice waveform data to synthesize the voice having the emphasis degree provided to the word or the collocation to be emphasized. Thereby, it is also possible to automatically decide the emphasis.

Further, by distributing and arranging respective functions, it is possible to build the voice synthesizer 1 to synthesize the voice with respect to the inputted sentence and output it.

In other words, the voice synthesizer 1 according to the present invention is configured by the pattern element analyzing unit 11 for analyzing a pattern element of a sentence and outputting an intermediate language with a rhythm mark to a character row of the sentence; the emphasis degree automatically deciding unit 36 for extracting a word or a collocation to be emphasized from among respective words or respective collocations on the basis of the frequency of appearance with respect to the each word or the each collocation included in a sentence and deciding an emphasis degree of the extracted word or the extracted collocation; the waveform dictionary 14 for storing the second voice waveform data, the phoneme position data indicating what phoneme a part of the voice belongs, and the pitch period data indicating a period of oscillation of a voice cord; the parameter generating unit 33 for generating a voice synthetic parameter including the phoneme position data and the pitch period data with respect to each word or each collocation that is decided by the emphasis degree automatically deciding unit 36 in the intermediate language that is outputted by the pattern element analyzing unit 11; and the pitch clipping and superimposing unit 15 for superimposing and adding processed voice waveform data obtained by processing the first voice waveform data at intervals indicated by the voice synthetic parameter generated by the parameter generating unit and a part of the second voice waveform data belonging to a waveform section at the preceding and succeeding sides of this processed voice waveform data to synthesize the voice having the emphasis degree provided to the word or the collocation to be emphasized.

Accordingly, according to this structure, the voice synthesizer 1 remotely arranges respective functions and can transmit and receive the data or a signal via a communication circuit by providing a data transmission/reception circuit (its illustration is omitted) to respective functions, and thereby, respective functions can be effected.

According to such a structure, a voice synthesizing method according to the present invention and an example that the word or the collocation to be emphasized is automatically emphasized by the present voice synthesizer 1 will be described below.

According to the voice synthesizing method of the present invention, the emphasis degree automatically deciding unit 36 may count a reference value with respect to the extraction of respective words or respective collocation, which extracts a word or a collocation to be emphasized from among respective words or respective collocations on the basis of an extracting reference such as the frequency of appearance, with respect to the each word or the each collocation included in a sentence and decides an emphasis degree of the extracted word or the extracted collocation (a counting step).

In addition, the common memory 39 may hold the reference value counted by the counting step and the respective words or the respective collocations with related to each other (a holding step). Then, the word emphasis degree deciding unit 38 may extract the word or the collocation with a high reference value held by the holding step (an extracting step), and may decide the emphasis degree with respect to the word or the collocation extracted by the extracting step (a word deciding step). Then, a voice having the emphasis degree decided by the word deciding step provided to the word or the collocation to be emphasized is synthesized (a voice synthesizing step).

Accordingly, it is possible to set apart that is emphasized by the user.

The frequency of word appearance counting unit 37 (see FIG. 1) may hold a specific word or a specific collocation of which frequency of appearance is counted in the common memory 39 in advance. In this case, a threshold value of the frequency of appearance is written in advance.

When a text sentence including a kana-kanji mixed sentence is inputted, the frequency of word appearance counting unit 37 may extract the frequency of appearance of the specific word or the specific collocation from among many character rows included in the text sentence, and by pairing the extracted word and the frequency of appearance, the frequency of word appearance counting unit 37 may store it in the first row (word) and the second row (the frequency of appearance) of the common memory 39. Thereby, the frequency of appearance of the specific word included in many character rows is counted.

Further, the word emphasis degree deciding unit 38 may read the frequency of appearance with respect to each word from the common memory 39, may decide with or without of the emphasis with respect to each word, and then, may store with or without of the emphasis in the third row (with or without of the emphasis) corresponding to the decided word.

In this case, the word emphasis degree deciding unit 38 may set a threshold value to decide this with or without of the emphasis, for example, at three times. Thereby, when the frequency of appearance of the word, "jikanteki" is twice, the word emphasis degree deciding unit 38 may record "absence" with respect to "with or without of the emphasis" of the common memory 39, and when the frequency of appearance of the word, "akusento" is four times, the word emphasis degree deciding unit 38 may record "presence" with respect to "with or without of the emphasis" of the common memory 39.

Then, the parameter generating unit 33 shown in FIG. 1 may read the third row of the common memory 39 for each word or each collocation, and if the emphasis is present, the parameter generating unit 33 may generate a parameter and may output this parameter to the pitch clipping and superimposing unit 15.

In addition, the pitch clipping and superimposing unit 15 may clip the voice waveform data stored in the waveform dictionary 14 and may superimpose and add the processed voice waveform data having the clipped voice waveform data multiplied by a window function and a part of the second voice waveform data belonging to the preceding and succeeding sections in adjacent to the section (the waveform section) to which this processed voice waveform data belongs to synthesize the voice.

The outputted synthetic voice is amplified by an amplifier circuit (its illustration is omitted) and a voice is outputted from a speaker (its illustration is omitted) to reach the user.

Thus, the present voice synthesizer 1 can obtain the emphasized part of the word or the collocation automatically on the basis of the frequency of appearance of the emphasized part of each word or each collocation. Thereby, the operationality can be improved by omitting a labor work needed by the manual input of the prominence by the user to synthesize a voice that can be easily caught by the user.

(A2) A Second Aspect

As the extracting reference of the first embodiment, a parameter to decide the emphasis degree on the basis of the frequency of appearance is used, however, here, a method to decide the emphasis degree on the basis of the number of times of appearance other than the frequency of appearance and the level of importance will be described in detail below.

Figure 5:
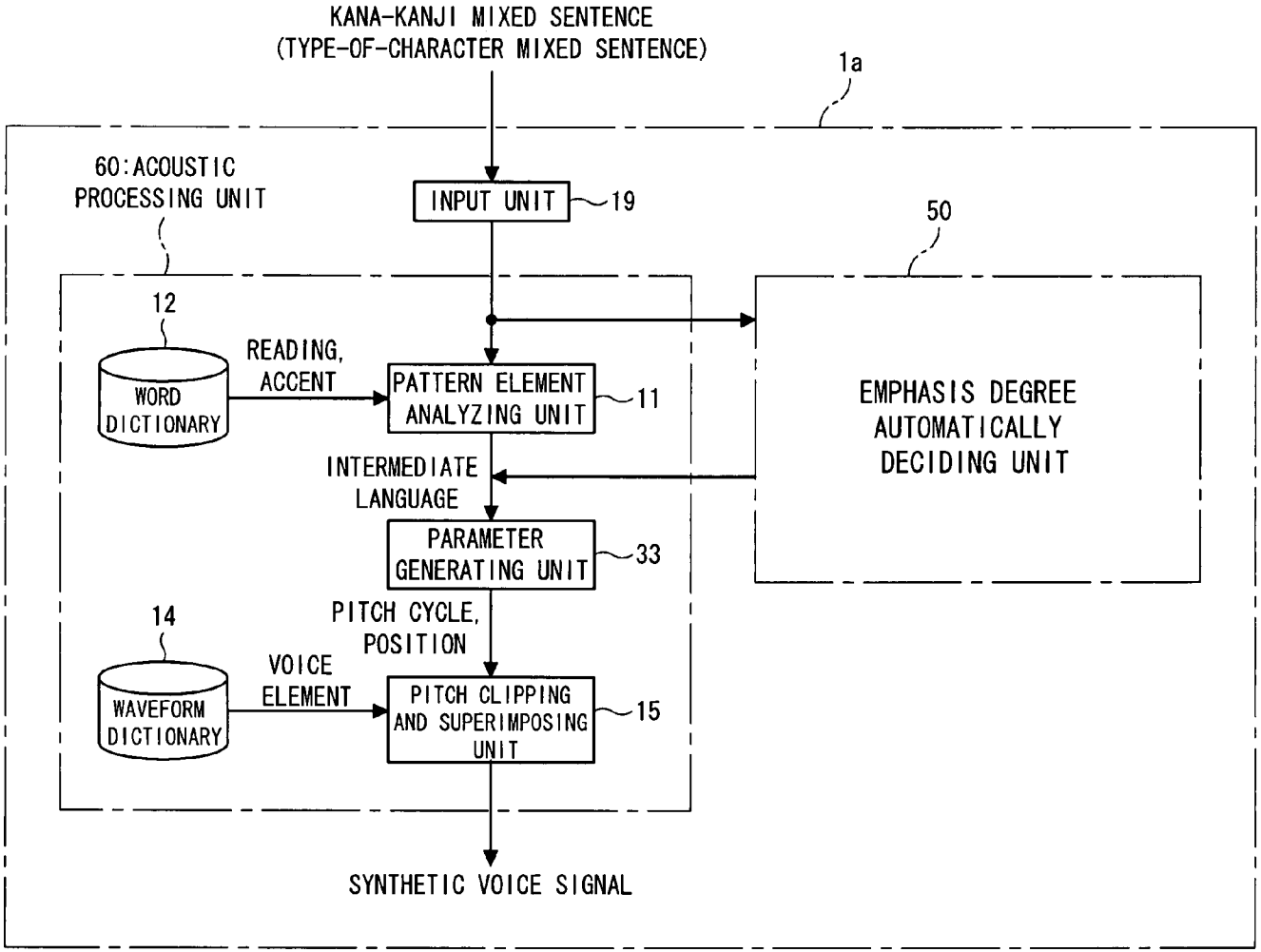
FIG. 5 is a block diagram of a second voice synthesizer according to the embodiment of the present invention.

FIG. 5 is a block diagram of a second voice synthesizer according to an embodiment of the present invention. A voice synthesizer 1*a* shown in FIG. 5 may read the inputted sentence to synthesize a voice, and the voice synthesizer 1*a* is configured by an emphasis degree automatically deciding unit 50, the input unit 19, and the acoustic processing unit 60.

In this case, the emphasis degree automatically deciding unit 50 may extract a word or a collocation to be emphasized from among respective words or respective collocations on the basis of the frequency of appearance with respect to the each word or the each collocation included in a sentence and may decide an emphasis degree of the extracted word or the extracted collocation.

In addition, the acoustic processing unit 60 may synthesize a voice having the emphasis degree decided by the emphasis degree automatically deciding unit 50 provided to the above-described each word or each collocation to be emphasized.

Figure 6:
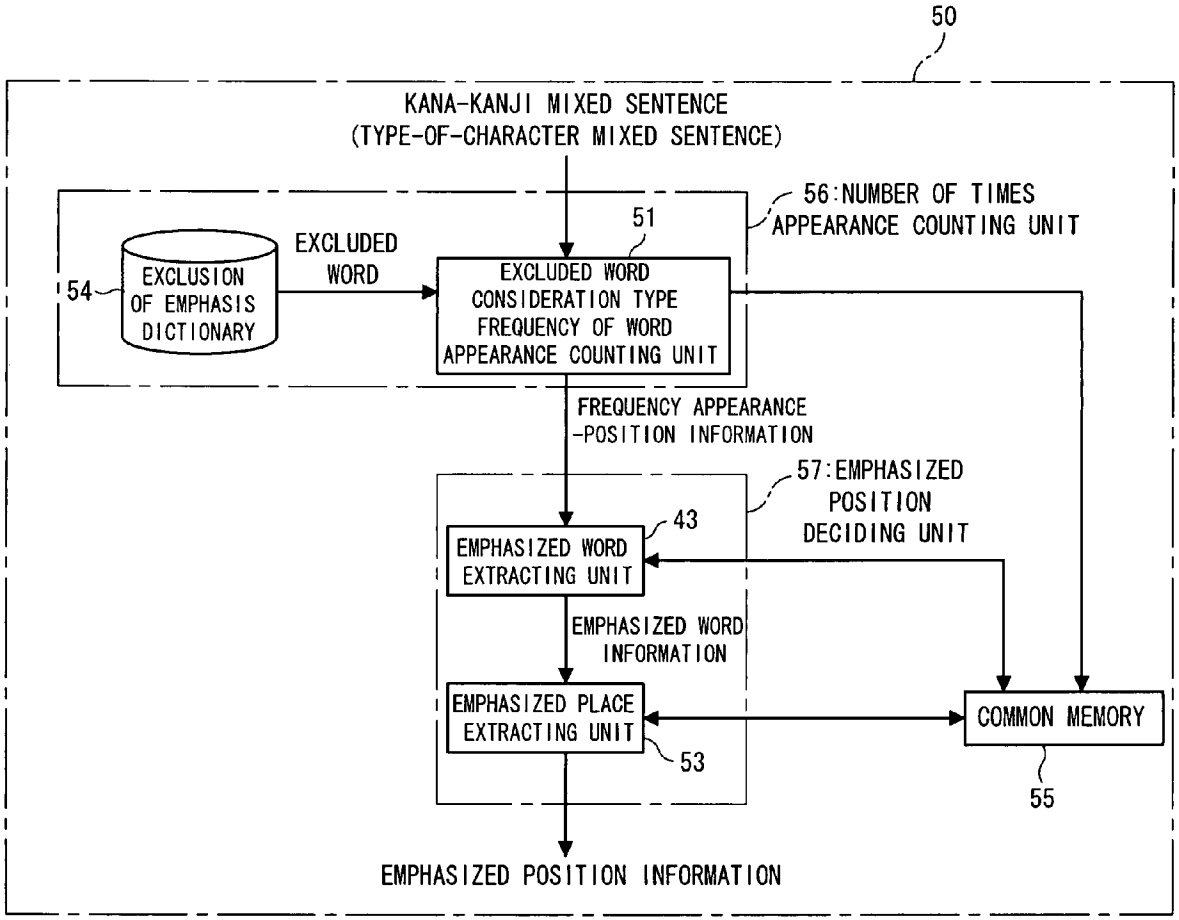
FIG. 6 is a block diagram of a second word emphasis degree deciding unit according to the embodiment of the present invention.

FIG. 6 is a block diagram of a second emphasis degree automatically deciding unit 50 according to the embodiment of the present invention. The emphasis degree automatically deciding unit 50 shown in this FIG. 6 is configured by a number of times of appearance counting unit 56, an emphasized position deciding unit 57, and a common memory 55.

In this case, the number of times of appearance counting unit 56 may extract a word or a collocation to be emphasized from among respective words or respective collocations on the basis of the extracting reference with respect to the each word or the each collocation included in a sentence and may decide an emphasis degree of the extracted word or the extracted collocation, and the number of times of appearance counting unit 56 is configured by an exclusion of emphasis dictionary 54 and an excluded word consideration type frequency of word appearance counting unit 51. This exclusion of emphasis dictionary 54 may exclude the emphasis with respect to the word or the collocation not requiring the emphasis of the voice in the inputted sentence and may hold the dictionary data having the information with respect to the character row of a target of exclusion recorded therein. In addition, the excluded word consideration type frequency of word appearance counting unit 51 may count the number or the like of each word or each collocation included in the sentence. The excluded word consideration type frequency of word appearance counting unit 51 may determine if the word or the collocation is included in a target of counting or the excluded word (or the excluded collocation) not requiring counting, and then, the excluded word consideration type frequency of word appearance counting unit 51 may sequentially record the detail information such as the number of times of appearance and the appearance position or the like with respect to each word or each collocation in the common memory 55.

FIG. 7 shows a data example of a third common memory 55 according to the embodiment of the present invention. According to a data structural example of the common memory 55 shown in FIG. 7, the data with respect to a row showing the number of times of appearance about the word, "jikanteki", a row showing the appearance position of the word, and a row indicating if the word, "jikanteki" is emphasized or not, and the information with respect to the strongly emphasized position or the weakly emphasized position are stored with related to each other. For example, with respect to the word, "jikanteki", the number of times of appearance is 2 and the appearance positions are 21 and 42. This means that the word, "jikanteki" appears twice and the first appearance position is 21st position or 42nd position from the position where the first word appears.

Then, for example, since the word, "jikanteki" has a few times of appearance, it is determined that "with or without of emphasis" is absence, and since the appearance position of the word, "akusento" is 15, 55, 83, and 99, and the number of times of appearance is four, it is determined that "with or without of emphasis" is presence. In addition, with respect to each of four appearance positions, the position to be strongly emphasized (the strongly emphasized position) or the position to be weakly emphasized (the weakly emphasized position) are recorded.

The emphasis degree automatically deciding unit 50 can variously decide the extracting reference, for example, the emphasis degree automatically deciding unit 50 can decide that the word, "akusento" is strongly emphasized at the appearance position 15 where the word, "akusento" appears at first; the word, "akusento" is weakly emphasized at the appearance positions 55 and 83 where the word, "akusento" appears secondly and thirdly; and further, the emphasis is not necessary with respect to the word, "akusento" at the appearance position 99 where the word, "akusento" appears fourthly.

Accordingly, the emphasis degree automatically deciding unit 50 may decide the emphasis degree on the basis of the appearance position of the word or the collocation and the number of times of appearance at the appearance position. Specifically, at the first appearance position of the word or the collocation, the emphasis degree of the word or the collocation is decided; and at the appearance position where the word or the collocation appears at a second time or after, the weak emphasis degree is decided or no-emphasis is decided.

Thereby, a delicate voice can be synthesized so that the emphasis degrees of the same word at the different appearance positions are made different respectively.

In addition, thereby, the number of times of appearance counting unit 56 (see FIG. 6) may extract the pair data of the appearance frequency—position information on the basis of each of the number of times of appearance, the frequency of appearance, and the information relating to with or without of emphasis in the data with respect to the word or the collocation stored in the common memory 55 and may input it in the emphasized position deciding unit 57 (see FIG. 6).

In addition, the emphasized position deciding unit 57 shown in FIG. 6 is configured by an emphasized word extracting unit 43 for writing the word or the collocation appeared at a predetermined number of time in the common memory 55; and an emphasized place extracting unit 53 for storing the information with respect to the delicate emphasis such that the emphasis word is strongly emphasized, for example, at the position where it appears at the first time and the emphasized word is weakly emphasized at a position where it appears at the second time or thereafter in the fifth row and the sixth row of the common memory 55.

In the meantime, except for the emphasis degree automatically deciding unit 50, the parts shown in this FIG. 7 having the same reference numerals as the above-described parts are the same parts or have the same functions, so that further explanation thereof is herein omitted.

According to such a structure, the emphasis degree automatically deciding unit 50 shown in FIG. 6 may count the frequencies of appearance (total number of times) of respective words of the inputted sentence by the frequency of word appearance counting unit 51 and a position of the word in the sentence is stored in the first to third rows of the common memory 55 as the number of the words.

Further, the emphasis degree automatically deciding unit 50 excludes the words registered in the exclusion of emphasis dictionary 54. The exclusion of emphasis dictionary 54 is used in order to prevent emphasis of the words that seem to be not so important although their frequencies of appearance are high. For example, it is preferable that ancillary words such as a postposition and an auxiliary verb or the like, a demonstrative pronoun such as "are" and "sono" or the like, a pronoun such as "koto", "tokoro", and "toki" or the like, and an auxiliary declinable word such as "aru", "suru", and "yaru" or the like are stored in the exclusion of emphasis dictionary 54.

In the next place, for example, the emphasized word extracting unit 43 may write the word that appears three times or more in the fourth row of the common memory 55 as the word to be emphasized. The emphasized place extracting unit 53 may store the word to be emphasized in the fifth row and the sixth row of the common memory 55 so that, for example, the first appearance place is strongly emphasized and the second appearance places or thereafter is weakly emphasized.

In addition, the parameter generating unit 33 (see FIG. 1) may generate a parameter to emphasize the word at the retrieved position strongly or weakly with reference to the fifth row and the sixth row of the common memory 55.

Thus, the emphasis degree automatically deciding unit 50 sets strong emphasis at the first appearance place of the word, weak emphasis at the second appearance place or thereafter of the word, and no need of emphasis, so that it is possible to prevent redundancy that occurs when the user listens to the sentence that is repeated by a voice with the same emphasis.

(A3) A Third Aspect

In a voice synthesizer according to the third embodiment, a word storing unit for recording a level of importance of the word or the collocation is provided, and thereby, in accordance with the importance, the word or the collocation is emphasized in multi-stages. A schematic structure of a voice synthesizer 1*c* according to the third embodiment is the same as the structure of the voice synthesizer 1 shown in FIG. 1.

Figure 8:
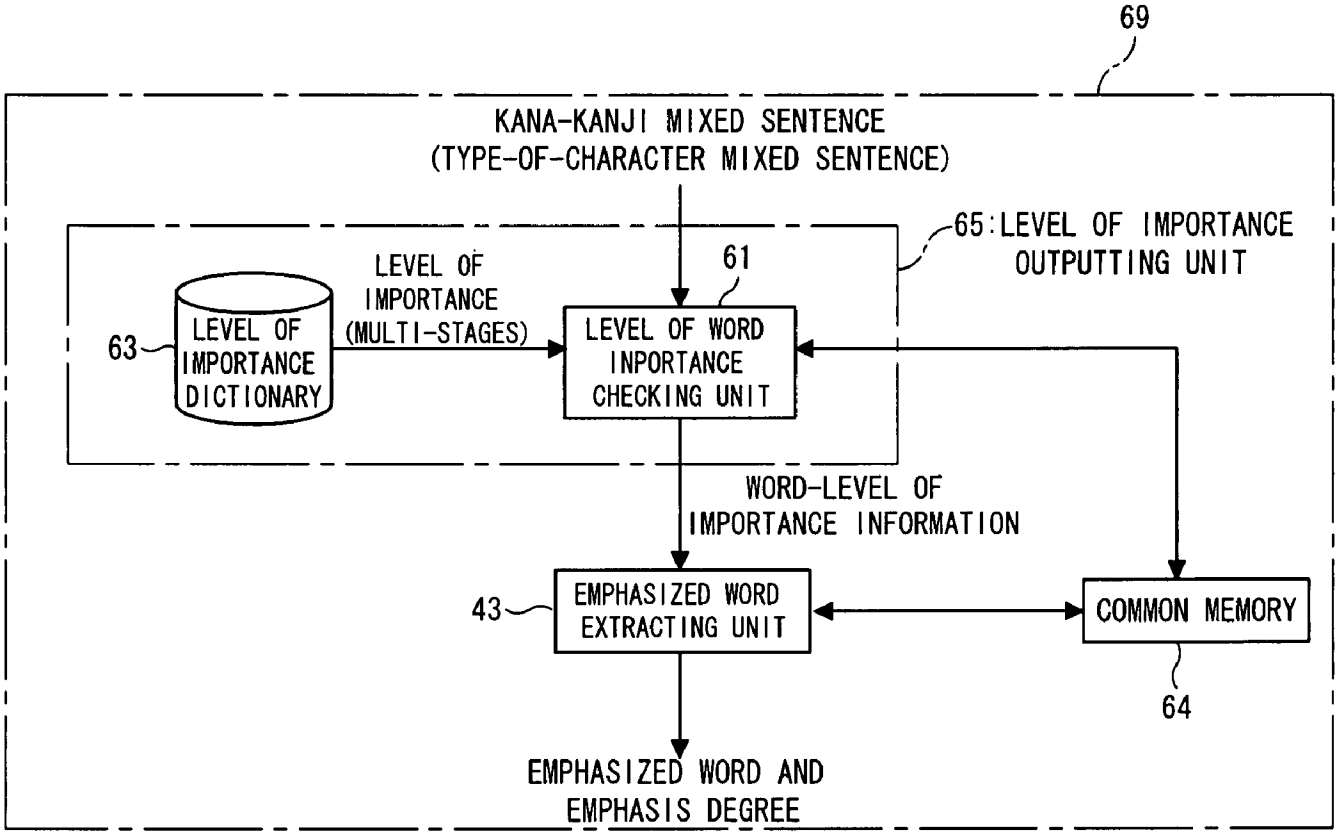
FIG. 8 is a block diagram of a third word emphasis degree deciding unit according to the embodiment of the present invention.

FIG. 8 is a block diagram of a third emphasis degree automatically deciding unit according to the embodiment of the present invention. An emphasis degree automatically deciding unit 69 shown in this FIG. 8 is configured by a level of importance outputting unit 65, an emphasized word extracting unit 43, and a common memory 64. This level of importance outputting unit 65 provides the level of importance in multi-stages to the word or the collocation and outputs the pair data of the word and the level of importance, and the level of importance outputting unit 65 is configured by a level of importance dictionary 63 for holding the word or the collocation and the level of importance in the multi-stage with related to each other and a level of word importance checking unit 61 for obtaining the information of a level of importance in the multi-stage with respect to the word of the collocation included in the inputted sentence with reference to the level of importance dictionary 63. In addition, the emphasized word extracting unit 43 is the same as the above-described one. In the meantime, the level of importance dictionary 63 may be configured so as to be customized for the user.

Further, the common memory 64 holds the word or the collocation that is counted by the level of importance outputting unit 65 and the level of importance thereof with related to each other.

FIG. 9 shows a data example of the fourth common memory 64 according to the embodiment of the present invention. The common memory 64 shown in this FIG. 9 stores the word and the level of importance (the emphasis level) of the word with related to each other. In addition, the number of rows of this common memory 64 can be increased and decreased. For example, for the word, "jikanteki", the emphasis level is "absent", and for the word, "akusento", the emphasis level is "strong".

Accordingly, the emphasis degree automatically deciding unit 60 may decide the emphasis degree in the multi-stage as the extracting reference on the basis of the level of importance that is provided to a specific word or a specific collocation in the above-described word or collocation.

In the meantime, the voice synthesizer 1*c* according to the present invention does not extract the key word from the inputted voice waveform data but reads the text sentence, and the voice synthesizer 1*c* can decide the emphasis degree by using the multi-stage level.

According to such a structure, the level of word importance checking unit 61 may obtain the level of importance of the word in the multi-stage included in the inputted sentence with reference to the level of importance dictionary 63, and may store the emphasis degree in response to the obtained level of importance in the common memory 64. The emphasized word extracting unit 43 may output the stored emphasis degree to the parameter generating unit 33 (see FIG. 1).

Thus, by using the level of importance dictionary 63, it is possible to reliably emphasize the word to be emphasized in accordance with the level of emphasis.

(A4) A Forth Aspect

A voice synthesizer according to the fourth embodiment is provided with a part of speech analyzing function capable of analyzing a part of speech of the word, and thereby, a proper noun is emphasized. The schematic structure of a voice synthesizer 1*d* according to the fourth embodiment is the same as the structure of the voice synthesizer 1 shown in FIG. 1.

Figure 10:
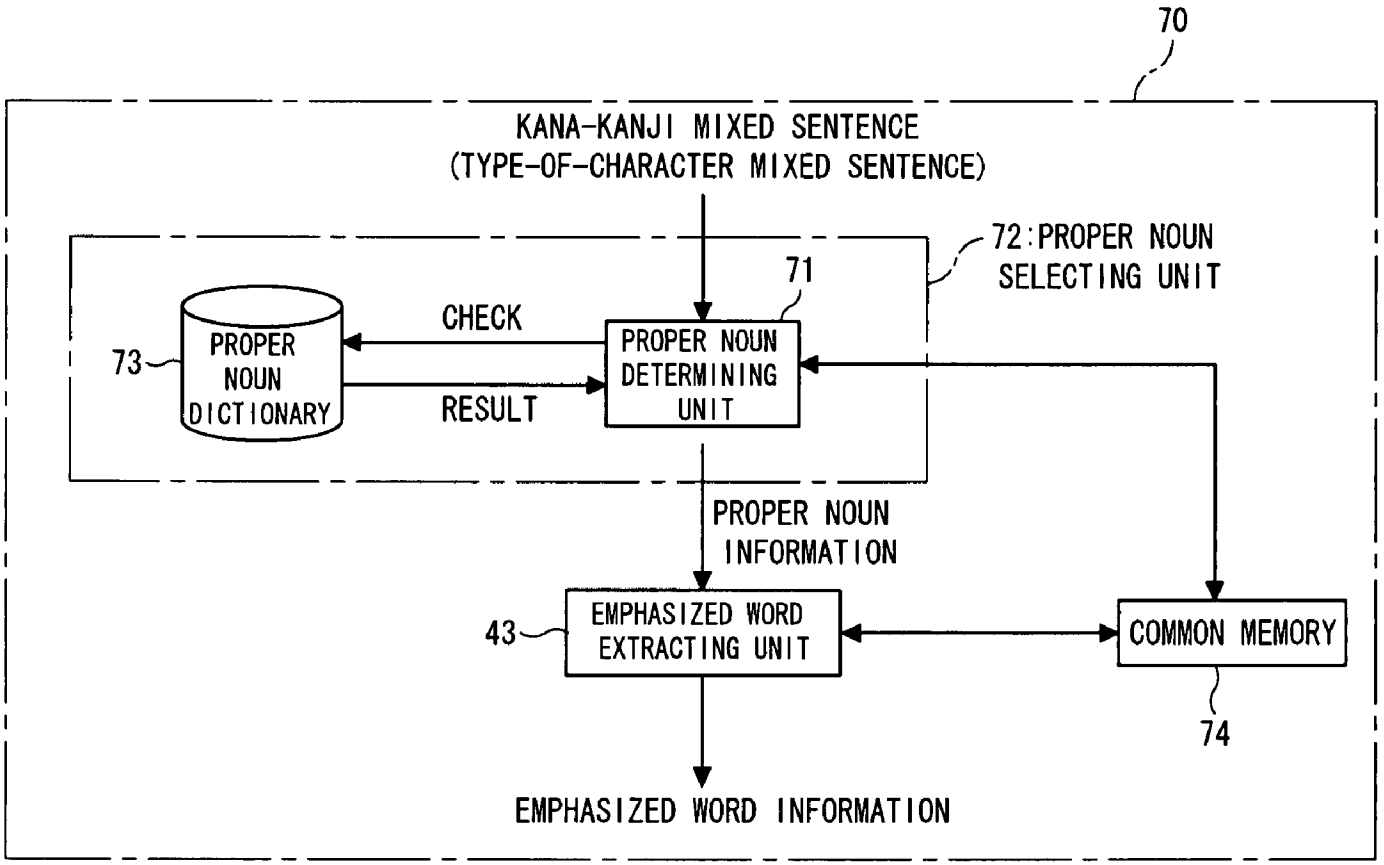
FIG. 10 is a block diagram of a fourth word emphasis degree deciding unit according to the embodiment of the present invention.

FIG. 10 is a block diagram of a fourth emphasis degree automatically deciding unit according to the embodiment of the present invention. An emphasis degree automatically deciding unit 70 shown in this FIG. 10 is configured by a common memory 74, a proper noun selecting unit 72, and an emphasized word extracting unit 43. This common memory 74 may hold the words or the collocations and a corresponding relation of "presence of emphasis" with respect to the proper noun in these words and collocations.

FIG. 11 shows a data example of a fifth common memory 74 according to the embodiment of the present invention. The common memory 74 shown in this FIG. 11 stores the corresponding relation that the emphasis is not needed with respect to the words, "jikanteki", and "akusento" or the like, and on the other hand, for example, the common memory 74 stores the corresponding relation that emphasis is needed with respect to the proper noun, "arupusu". In the meantime, the number of rows of the common memory 74 can be increased and decreased.

In addition, the proper noun selecting unit 72 (see FIG. 10) is configured by a proper noun dictionary 73 and a proper noun determining unit 71. This proper noun dictionary 73 may hold a part of speech of the word or the collocation, and the proper noun determining unit 71 may determine if the word or the collocation included in the inputted character row is a proper noun or not by checking the word or the collocation with the proper noun dictionary 73. When the word is the proper noun, the proper noun determining unit 71 may write "presence of emphasis" in the common memory 74, and when the word is not the proper noun, the proper noun determining unit 71 may write "absence of emphasis" in the common memory 74. Then, the emphasized word extracting unit 43 may output with or without of the emphasis stored in the common memory 74 to the parameter generating unit 33.

Accordingly, the emphasis degree automatically deciding unit 70 may decide the emphasis degree as the extracting reference on the basis of the specific proper noun included in the sentence.

According to such a structure, when the sentence is inputted in the proper noun selecting unit 72 with the common memory 74 initialized, the proper noun determining unit 71 may determine if the word or the collocation included in the sentence is the proper noun or not with reference to the proper noun dictionary 73. If this determination result is the proper noun, the proper noun determining unit 71 may output the proper noun information (the information indicating that the word is the proper noun), and the emphasized word extracting unit 43 may emphasize this word. In addition, when the determination result is not the proper noun, the proper noun determining unit 71 does not output the proper noun information.

During this operation, the proper noun determining unit 71 continues to record each determination result in the common memory 74 till the input of the character row stops. Accordingly, the common memory 74 records the data with respect to with or without of emphasis of many words or many collocations.

Thus, since the proper noun in the character row is emphasized, the voice synthesizer can synthesize the voice that can be easily caught by the user as the entire sentence.

(A5) A Fifth Aspect

A voice synthesizer according to the fifth embodiment emphasizes the word or the collocation that is spelled by, for example, katakana in the character type. The schematic structure of a voice synthesizer 1*e* according to the fifth embodiment is the same as the structure of the voice synthesizer 1 shown in FIG. 1.

Figure 12:
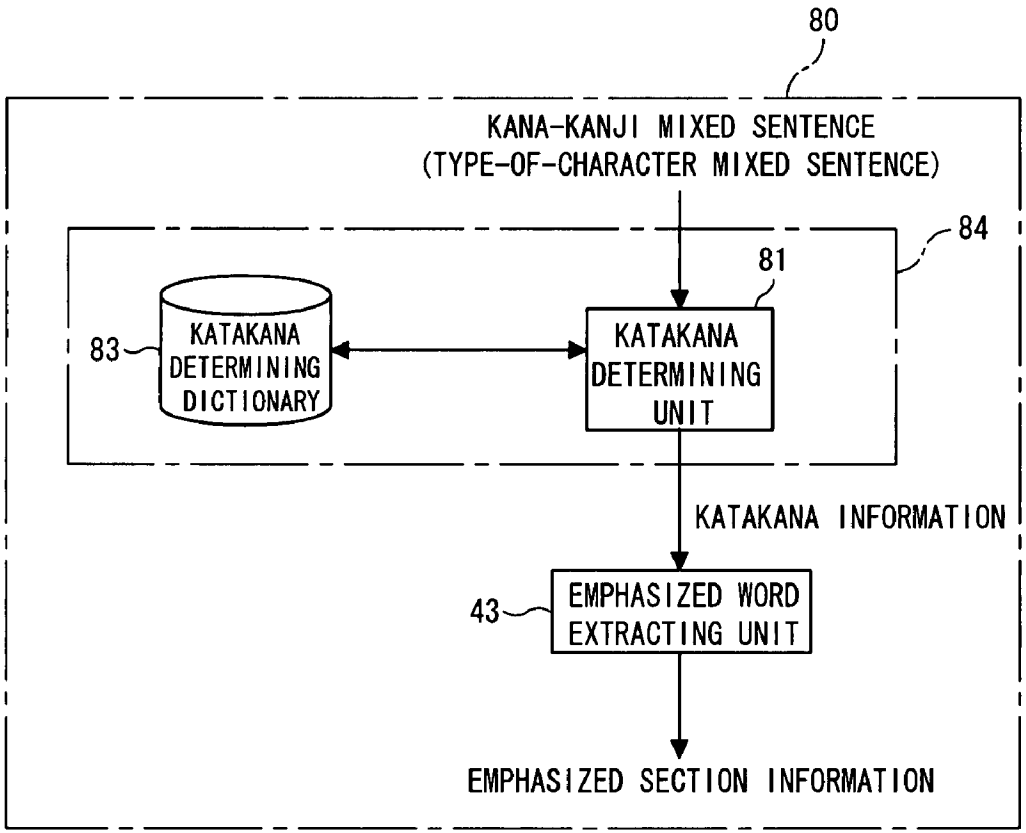
FIG. 12 is a block diagram of a fifth word emphasis degree deciding unit according to the embodiment of the present invention.
Figure 13:
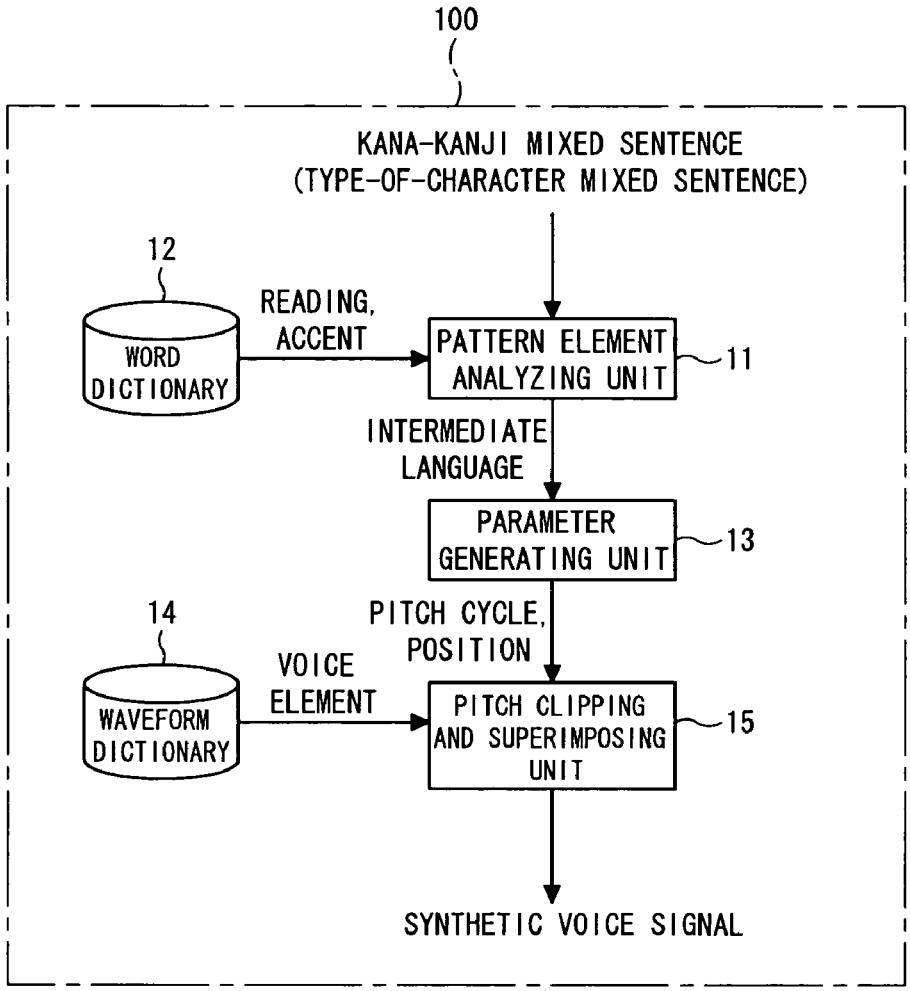
FIG. 13 is a block diagram of a voice synthesizer using no prominence.
Figure 14:
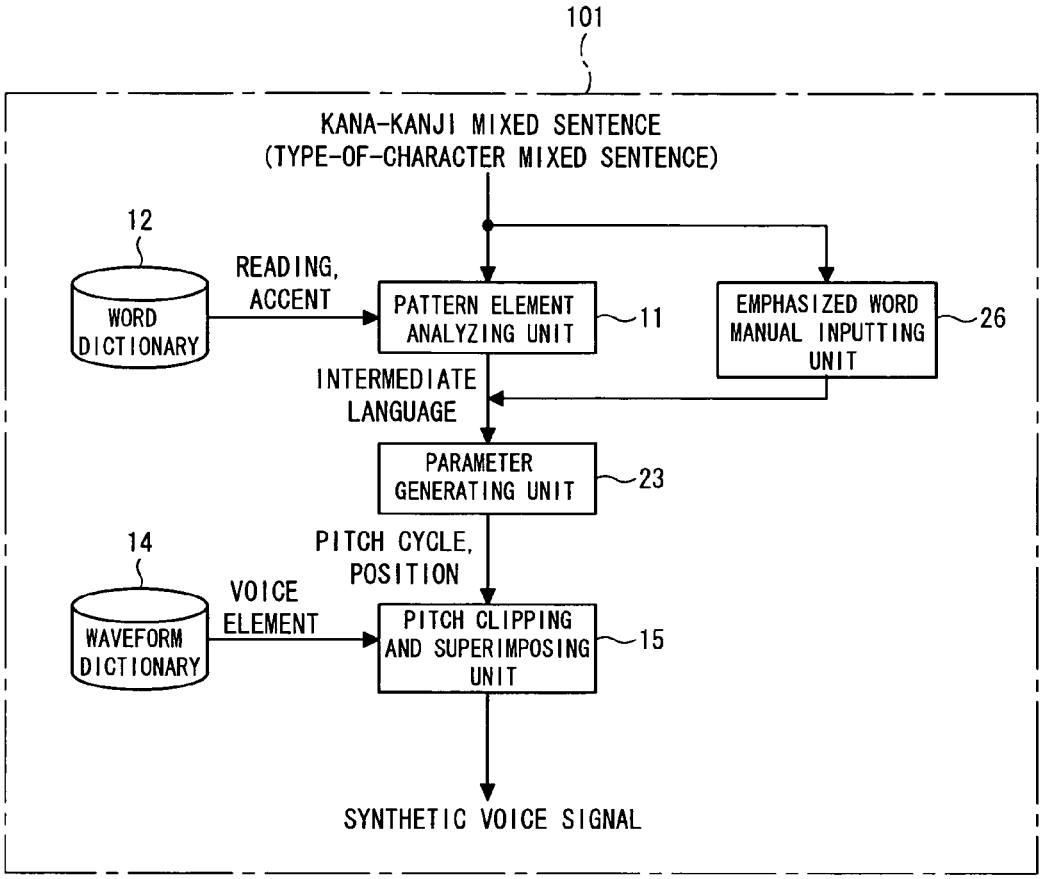
FIG. 14 is a block diagram of a voice synthesizer using a prominence.
Figures 15A, 15B, 15C, 15D:
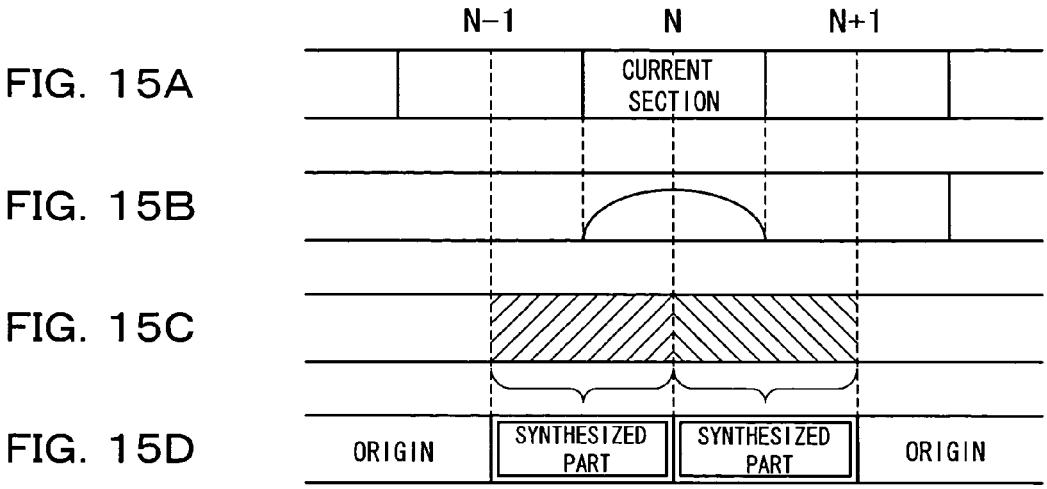
FIG. 15A to FIG. 15D illustrate an addition and superimposing method of a waveform, respectively.

FIG. 12 is a block diagram of a fifth word emphasis degree automatically deciding unit according to the embodiment of the present invention. An emphasis degree automatically deciding unit 80 shown in this FIG. 12 is provided with a katakana word selecting unit 84 and the emphasized word extracting unit 43. In addition, the katakana word selecting unit 84 may determine if the inputted word or the inputted collocation is the katakana word or not with reference to a katakana determining dictionary 83 holding the katakana word. This katakana determining dictionary 83 may be also provided in the above-described proper noun dictionary 73 (see FIG. 10).

In addition, not only katakana, but also, for example, the character type such as alphabet, a Greek character, and a special kanji or the like also can be emphasized. In other words, this emphasis degree automatically deciding unit 80 can decide the emphasis degree as the extracting reference on the basis of various character types, for example, katakana, alphabet or a Greek character or the like included in a sentence.

According to such a structure, it is determined if the word or the collocation included in the inputted sentence is spelled by katakana by the katakana determining unit 81, and if it is spelled by katakana, the katakana determining unit 81 may output the katakana information (the information indicating that the inputted character row is spelled by katakana). Then, the emphasized word extracting unit 43 may emphasize the word when the character is the katakana information, and when the character is not the katakana information, the emphasized word extracting unit 43 may output the word as it is.

Thus, by emphasizing the katakana word, it is possible to expect the synthetic voice, which can be easily caught in totality by the user.

(B) Others

The present invention is not limited to the above-described embodiments and their modifications and various modifications will become possible without departing from the scope thereof.

The rhythm mark of the intermediate language is to be considered as illustrative and as a matter of course, the present invention can be effected by various modifications. In addition, if a type of a parameter, a holding format of the data held in a common memory, a place for holding the data, or a processing method for each data is modified, a superiority of the present invention is not damaged at all.

Then, the present invention is not limited to the above-described embodiments and various modifications will become possible without departing from the scope thereof.

INDUSTRIAL APPLICABILITY

As described above, according to the voice synthesizer of the present invention, it is possible to solve a problem such that a user has to input a parameter such as tension of emphasis or the like manually each time a part to be emphasized appears, and to obtain an emphasized part of a word or a collocation automatically on the basis of an extracting reference such as a frequency of appearance of the word or the collocation and a level of importance thereof. Further, it is possible to provide a voice synthesizer, whereby the operationality can be improved by a simple structure, an emphasis degree can be automatically decided, and a voice that can be easily caught by the user can be synthesized. Therefore, the present invention can be used for respective apparatuses, for example, in a mobile communication, an Internet communication, and a field using the text data other than these. Thereby, the operationality of the voice synthesizer can be improved in various aspects such as expressivity, safety, and security or the like.

What is claimed is:

1. A voice synthesizer, comprising:

an emphasis degree deciding unit for extracting a word or a collocation to be emphasized from among respective words or respective collocations on the basis of an extracting reference with respect to the each word or the each collocation included in a sentence and deciding an emphasis degree of the extracted word or the extracted collocation;

an acoustic processing unit for generating a voice having an emphasis degree that is decided by the emphasis degree deciding unit provided to the word to be emphasized or the collocation to be emphasized; and a dictionary for storing therein one or more non-emphasis words or one or more non-emphasis collocations that are not necessarily emphasized among the each word or the each collocation, wherein said emphasis degree deciding unit excludes the non-emphasis words or the non-emphasis collocations stored in said dictionary from one or more of the words or one or more of the collocations to be emphasized.

2. The voice synthesizer according to claim 1, wherein the emphasis degree deciding unit comprises a counting unit for counting a reference value with respect to extraction of each word or each collocation included in the sentence from which the non-emphasis words or the non-emphasis collocations are excluded;

a holding unit for holding the reference values counted by the counting unit and the each word or the each collocation with related each other; and a word deciding unit for extracting a word or a collocation with a high reference value among the reference values that is held in the holding unit and deciding the emphasis degree with respect to the extracted word or the extracted collocation.

3. The voice synthesizer according to claim 1, wherein the emphasis degree deciding unit decides the emphasis degree as the extracting reference on the basis of a frequency of appearance of the respective words or the respective collocations.

4. The voice synthesizer according to claim 1, wherein the emphasis degree deciding unit decides the emphasis degree as the extracting reference on the basis of a specific proper noun included in the sentence.

5. The voice synthesizer according to claim 1, wherein the emphasis degree deciding unit decides the emphasis degree as the extracting reference on the basis of a type of a character included in the sentence.

6. The voice synthesizer according to claim 1, wherein the emphasis degree deciding unit decides the emphasis degree in multi-stages as the extracting reference on the basis of a level of importance that is provided to a specific word or a specific collocation among the respective words or the respective collocations.

7. The voice synthesizer according to claim 1, wherein the acoustic processing unit comprises a pattern element analyzing unit for analyzing a pattern element of the sentence and outputting an intermediate language with a rhythm mark to a character row of the sentence;

a parameter generating unit for generating a voice synthetic parameter with respect to each word or each collocation that is decided by the emphasis degree deciding unit in the intermediate language with the rhythm mark that is outputted by the pattern element analyzing unit; and a pitch clipping and superimposing unit for superimposing and adding processed voice waveform data obtained by processing first voice waveform data at intervals indicated by the voice synthetic parameter generated by the parameter generating unit and a part of second voice waveform data belonging to a waveform section at the preceding and succeeding sides of this processed voice waveform data to synthesize the voice having the emphasis degree provided to the word or the collocation to be emphasized.

8. The voice synthesizer according to claim 1, wherein the emphasis degree deciding unit decides the emphasis degree as the extracting reference on the basis of an appearance place of the respective words or the respective collocations and the number of times of the appearance place.

9. The voice synthesizer according to claim 8, wherein the emphasis degree deciding unit decides the emphasis degree with respect to the each word or the each collocation at a first appearance place of the each word or the each collocation, and decides a weak emphasis or no-emphasis at the appearance place where the each word or the each collocation appears on and after a second time.

10. A voice synthesizer, comprising:

a pattern element analyzing unit for analyzing a pattern element of a sentence and outputting an intermediate language with a rhythm mark to a character row of the sentence;

an emphasis degree deciding unit for extracting a word or a collocation to be emphasized from among respective words or respective collocations on the basis of an extracting reference with respect to the each word or the each collocation included in a sentence and deciding an emphasis degree of the extracted word or the extracted collocation;

a waveform dictionary for storing second voice waveform data, the phoneme position data indicating what phoneme a part of the voice belongs, and the pitch period data indicating a period of oscillation of a voice cord;

a parameter generating unit for generating a voice synthetic parameter including at least the phoneme position data and the pitch period data with respect to each word or each collocation that is decided by the emphasis degree deciding unit in the intermediate language that is outputted by the pattern element analyzing unit; and a pitch clipping and superimposing unit for superimposing and adding processed voice waveform data obtained by processing first voice waveform data at intervals indicated by the voice synthetic parameter generated by the parameter generating unit and a part of second voice waveform data belonging to a waveform section at the preceding and succeeding sides of this processed voice waveform data to synthesize the voice having the emphasis degree provided to the word or the collocation to be emphasized.

11. The voice synthesizer according to claim 10, wherein the pitch clipping and superimposing unit; clips the voice waveform data stored in the waveform dictionary on the basis of the pitch period data generated by the parameter generating unit; and superimposes and adds the processed voice waveform data having clipped voice waveform data multiplied by a window function and a part of second voice waveform data belonging to a waveform section at the preceding and succeeding sides of this processed voice waveform data to synthesize the voice.

12. A voice synthesizing method, comprising the steps of:

counting a reference value with respect to extraction of each word or each collocation by an emphasis degree deciding unit for extracting a word or a collocation to be emphasized from among respective words or respective collocations, from which one or more non-emphasis words or one or more non-emphasis collocations that are stored in a dictionary, and which are not necessarily emphasized among the each word or the each collocation, are excluded, on the basis of an extracting reference with respect to the each word or the each collocation included in a sentence and deciding an emphasis degree of the extracted word or the extracted collocation;

holding the reference values counted by the counting step and the each word or the each collocation with relation to each other;

extracting a word or a collocation with a high reference value that is held in the holding step;

deciding the emphasis degree with respect to the extracted word or the extracted collocation by the extracting step; and generating the voice having the emphasis degree that is decided in the word deciding step provided to the word or the collocation to be emphasized.

13. A voice synthesizing system for synthesizing a voice with respect to an inputted sentence and outputting the voice, comprising:

a pattern element analyzing unit for analyzing a pattern element of the sentence and outputting an intermediate language with a rhythm mark to a character row of the sentence;

an emphasis degree deciding unit for extracting a word or a collocation to be emphasized from among respective words or respective collocations on the basis of an extracting reference with respect to the each word or the each collocation included in a sentence and deciding an emphasis degree of the extracted word or the extracted collocation;

a waveform dictionary for storing second voice waveform data, the phoneme position data indicating what phoneme a part of the voice belongs, and the pitch period data indicating a period of oscillation of a voice cord;

a parameter generating unit for generating a voice synthetic parameter including at least the phoneme position data and the pitch period data with respect to each word or each collocation that is decided by the emphasis degree deciding unit in the intermediate language that is outputted by the pattern element analyzing unit; and a pitch clipping and superimposing unit for superimposing and adding processed voice waveform data obtained by processing first voice waveform data at intervals indicated by the voice synthetic parameter generated by the parameter generating unit and a part of second voice waveform data belonging to a waveform section at the preceding and succeeding sides of this processed voice waveform data to synthesize the voice having the emphasis degree provided to the word or the collocation to be emphasized.

* * * * *